US009933737B1

(12) United States Patent
Miyamae

(10) Patent No.: US 9,933,737 B1
(45) Date of Patent: Apr. 3, 2018

(54) IMAGE FORMING APPARATUS FOR CONTROLLING A POWER SUPPLY PROVIDED TO A STAPLE UNIT

(71) Applicant: KYOCERA Document Solutions Inc., Osaka (JP)

(72) Inventor: Tsubasa Miyamae, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/695,634

(22) Filed: Sep. 5, 2017

(30) Foreign Application Priority Data

Sep. 13, 2016 (JP) ..... 2016-178712

(51) Int. Cl.
*G03G 15/00* (2006.01)
*B65H 37/04* (2006.01)

(52) U.S. Cl.
CPC ..... *G03G 15/5004* (2013.01); *B65H 37/04* (2013.01); *G03G 15/6541* (2013.01); *G03G 15/80* (2013.01); *G03G 2215/00392* (2013.01)

(58) Field of Classification Search
CPC ..... G03G 15/5004; G03G 15/80
See application file for complete search history.

(56) References Cited

U.S. PATENT DOCUMENTS

2012/0128385 A1 5/2012 Song et al. ..... 399/88
2014/0239571 A1* 8/2014 Kakutani ..... G03G 15/5004 270/58.09
2015/0323894 A1* 11/2015 Hikichi ..... B65H 37/04 399/88

FOREIGN PATENT DOCUMENTS

JP 2014-203014 A 10/2014
JP 2015-214034 A 12/2015

OTHER PUBLICATIONS

Extended European Search Report dated Jan. 17, 2018, issued by the European Patent Office in corresponding application EP 17189758.0.

* cited by examiner

*Primary Examiner* — Benjamin O Dulaney
(74) *Attorney, Agent, or Firm* — Stein IP, LLC

(57) ABSTRACT

An image forming apparatus includes a staple unit, a print unit, a power supply, and a control unit. When the time that elapses after completion of a print job equals a standby time, the control unit stops supply of electric power to the staple unit. When it is predicted that the printout of a print job does not require stapling, the control unit sets the standby time to a first time. When it is predicted that stapling is required, the control unit sets the standby time to a second time that is longer than the first time.

10 Claims, 7 Drawing Sheets

IMAGE FORMING APPARATUS FOR CONTROLLING A POWER SUPPLY PROVIDED TO A STAPLE UNIT

INCORPORATION BY REFERENCE

This application is based upon and claims the benefit of priority from the corresponding Japanese Patent Application No. 2016-178712 filed on Sep. 13, 2016, the entire contents of which are incorporated herein by reference.

BACKGROUND

The present disclosure relates to an image forming apparatus provided with a staple unit.

Some image forming apparatuses are fitted with a post-processing device (finisher). Post-processing devices perform various kinds of post-processing on printed sheets. For example, post-processing devices include a punch mechanism and a staple mechanism. The punch mechanism creates holes in printed sheets. The staple mechanism staples a bundle of sheets. When an image forming apparatus makes a transition to a power saving state, a post-processing device may also be brought into a power saving state. In this case, supply of electric power to the post-processing device stops. Thus, even when the post-processing device is used (contrary to the user's intention), supply of electric power to the post-processing device may stop.

One example of a technology is known for preventing a post-processing device, while in use, from being brought into a power saving state. Specifically, there is known an image forming apparatus connected to a finisher, wherein supply of electric power is controlled such that the image forming apparatus is either in a power saving state or in a non-power saving state, a transition to a power saving state is prohibited when sheets are detected having been set in the finisher, and a transition to a power saving state is made when no sheets are detected being set in the finisher on condition that a condition to make a transition to a power saving state is met.

Electric power is supplied to an optionally fitted unit such as a finisher usually from the main body (printer portion) of the image forming apparatus. Thus, when the main body of the image forming apparatus is brought into a power saving state, supply of electric power to the unit stops. This also brings the unit into a power saving state.

In the above-described known technology, sheets having been set in the finisher are detected. While sheets are being set in the finisher, the image forming apparatus recognizes that the user is operating the finisher. In the above-described known technology, for example, a CPU controls the transition to a power saving state. The above-described known technology presupposes recognizing that whether or not the finisher is mounted and recognizing whether or not sheets have been set in the finisher. That is, it presupposes that the control circuit in the main body and the finisher are communicably connected together via a plurality of signal lines.

On the other hand, some units fitted to image forming apparatuses are supplied only with electric power from the image forming apparatuses. Focusing exclusively on supply of electric power advantageously helps achieve simple wiring, reduced development man-hours, and reduced manufacturing cost. In this case, the control circuit in the main body and the fitted unit are not connected via a communication signal line. No data communication is performed between the control circuit and the fitted unit. The control circuit cannot check the condition of the fitted unit. For example, the control circuit cannot check whether or not the fitted unit is connected or whether or not sheets have been set in it.

It is necessary to bring also the fitted unit into a power saving state. Usually, when the image forming apparatus makes a transition to a power saving state, supply of electric power to the fitted unit whose condition cannot be checked stops. It can occur that, to effect the transition to a power saving state, supply of electric power to the fitted unit inconveniently stops when the user is about to use the fitted unit which does not communicate with the control circuit. When the supply of electric power stops, the fitted unit cannot be used.

Thus, the above-described known technology is not applicable to an image forming apparatus in which no communication is performed between a control circuit in its main body and a fitted unit. The above-described known technology cannot deal with the above-discussed problem.

SUMMARY

According to one aspect of the present disclosure, an image forming apparatus includes a staple unit, a data input portion, a print unit, a power supply, and a control unit. The staple unit includes a staple mechanism by which a staple is driven through a bundle of sheets and a driving source which makes the staple mechanism operate. The data input portion receives print data used for printing. The print unit executes a print job based on the print data. The power supply supplies electric power to the staple unit. The control unit makes the power supply supply electric power to the staple unit at least until a standby time elapses after completion of a print job, starts to count time that elapses after completion of a print job, and makes the power supply stop supply of electric power to the staple unit when the elapsed time equals the standby time. The control unit is not connected to the staple unit via a communication signal line, does not recognize whether or not the staple unit is present, predicts whether or not a printout of an executed print job requires stapling, sets, when it is predicted that no stapling is required, the standby time to a first time, and sets, when it is predicted that stapling is required, the standby time to a second time that is longer than the first time.

Further features and advantages of the present disclosure will become apparent from the description of embodiments given below.

DETAILED DESCRIPTION

The present disclosure prevents a stop of supply of electric power to a unit which a user is about to use even in an image forming apparatus in which no communication is performed between a control circuit in its main body and the unit. Hereinafter, an embodiment of the present disclosure will be described with reference to FIGS. 1 to 7. As an example of the image forming apparatus according to the embodiment, a multifunction peripheral 100 will be described. All features, such as structures and arrangements, described herein are merely examples for the sake of description, and are in no way meant to limit the scope of the disclosure.

Figure 1:
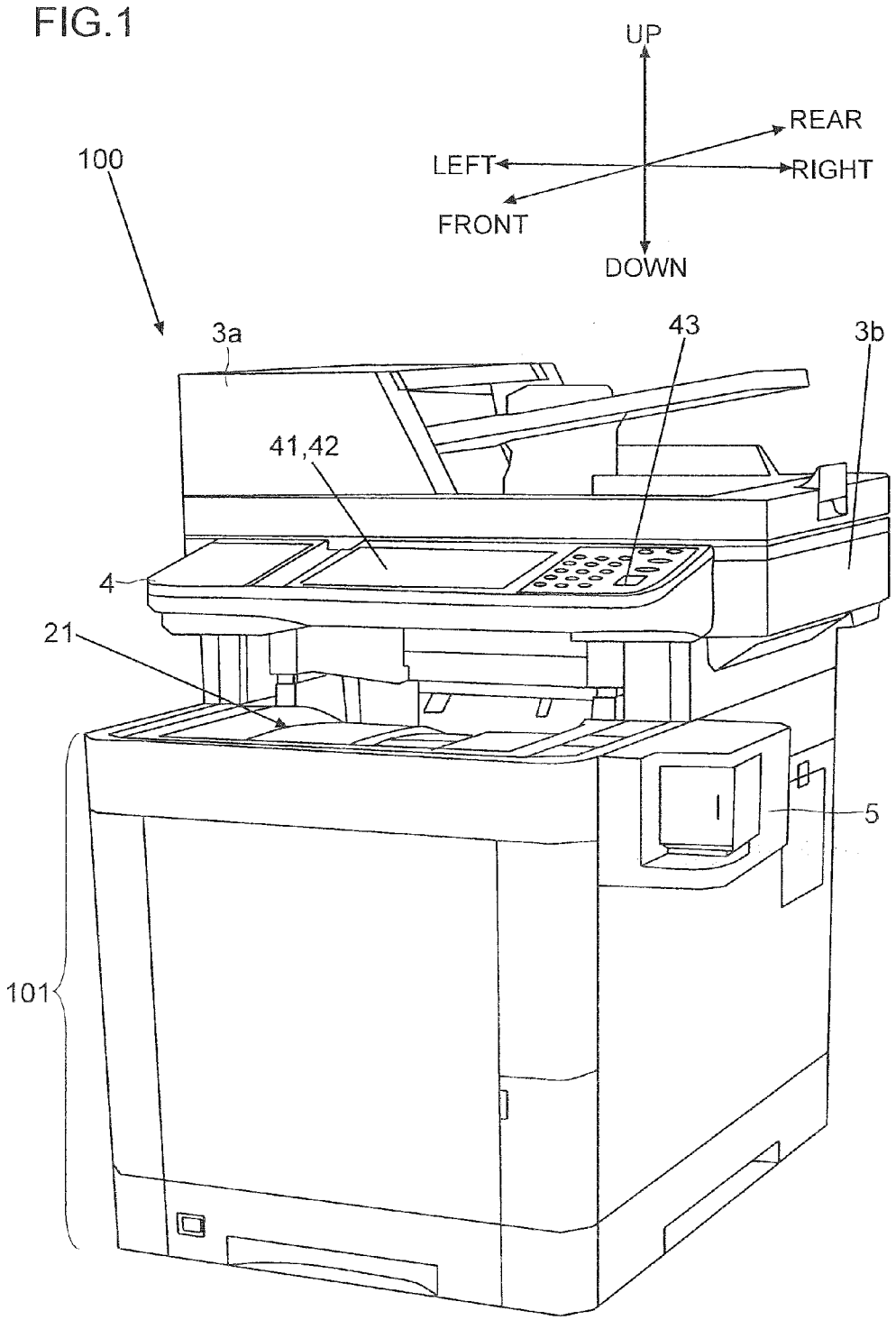
FIG. 1 is a diagram showing an example of a multifunction peripheral according to one embodiment.
Figure 2:
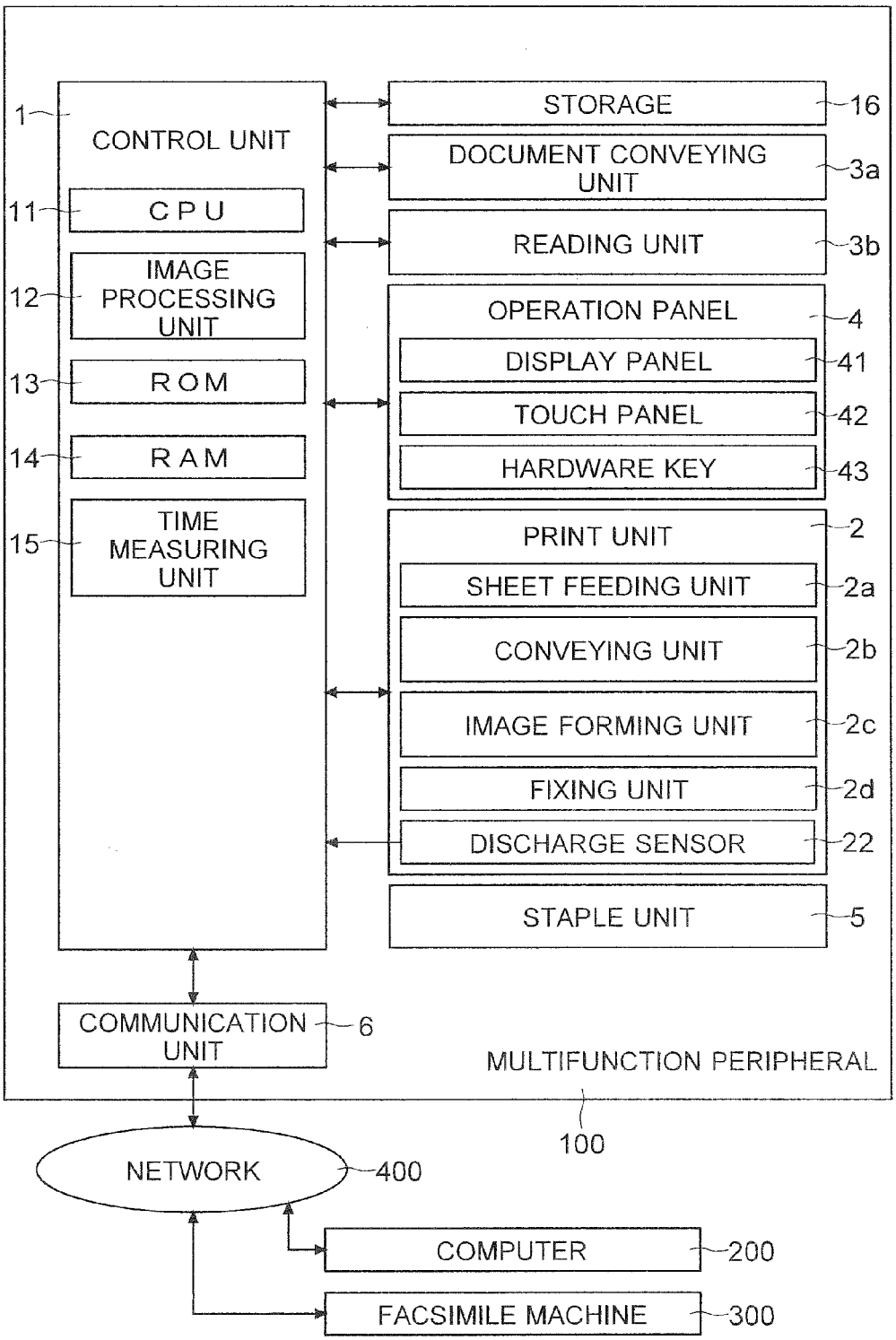
FIG. 2 is a diagram showing an example of the multifunction peripheral according to the embodiment.

Outline of Image Forming Apparatus:

With reference to FIGS. 1 and 2, an outline of the multifunction peripheral 100 according to the embodiment will be described. As shown in FIG. 1, the multifunction peripheral 100 has a main body 101. In the main body 101, there are arranged a control unit 1, a storage 16, a print unit 2, and a communication unit 6. Over the main body 101, a document conveying unit 3*a* and a reading unit 3*b* are arranged. On a front face of the reading unit 3*b*, an operation panel 4 is arranged. On a right side face of the main body 101, a staple unit 5 is arranged.

The control unit 1 is a circuit board. The control unit 1 controls components of the multifunction peripheral 100. The control unit 1 includes a CPU 11, an image processing unit 12, ROM 13, RAM 14, and a time measuring unit 15. The CPU 11 performs various calculations and processes. The image processing unit 12 is a circuit that subjects image data to image processing. The image processing unit 12 generates image data for printing and for transmission. The time measuring unit 15 is a circuit that measures time.

The storage 16 is a storage device with a large capacity. The storage 16 is, for example, a HDD. The storage 16 is communicably connected to the control unit 1. The CPU 11 performs calculations and processes based on the programs and data for control stored in the storage devices. The CPU 11 controls components of the multifunction peripheral 100.

In the document conveying unit 3*a*, a document is set. The control unit 1 makes the document conveying unit 3*a* convey the set document. The document conveying unit 3*a* conveys one document sheet after another toward a reading position (a feed-reading contact glass, unillustrated). The document conveying unit 3*a* conveys the document sheets successively and automatically. The control unit 1 makes the reading unit 3*b* read the document. The reading unit 3*b* reads a document conveyed or a document set on a placement-reading contact glass (unillustrated). The reading unit 3*b* generates image data of a read document.

The multifunction peripheral 100 has an operation panel 4. The operation panel 4 accepts operations by a user. The operation panel 4 includes a display panel 41, a touch panel 42, and hardware keys 43. The control unit 1 makes the display panel 41 display setting screens and various messages related to printing or scanning. The touch panel 42 overlaps the display panel 41. The hardware keys 43 include an operation key such as a Start key. The operation panel 4 accepts settings of conditions for execution of jobs (operations for setting set values). The jobs include, for example, a print job and a transmission job. The control unit 1 recognizes the content set on the operation panel 4.

The print unit 2 includes a sheet feeding unit 2*a*, a conveying unit 2*b*, an image forming unit 2*c*, and a fixing unit 2*d*. In printing, the control unit 1 makes the sheet feeding unit 2*a* feed out a sheet. The control unit 1 makes the conveying unit 2*b* convey the sheet fed out from the sheet feeding unit 2*a*. The control unit 1 makes the image forming unit 2*c* form a toner image based on image data. The image forming unit 2*c* transfers the toner image to the sheet which is conveyed. The control unit 1 makes the fixing unit 2*d* heat and press the sheet having the toner image transferred to it. Thereby, the toner image is fixed to the sheet. After the transfer, the sheet is discharged onto a discharge tray 21.

The control unit 1 is communicably connected to the communication unit 6. The communication unit 6 is a circuit board that communicates with a computer 200 or a facsimile machine 300 via a network 400. The computer 200 is, for example, a PC or server. The communication unit 6 includes a connector for communication and a chip for controlling communication. Based on the print data (image data and print settings) received from the computer 200, the control unit 1 makes the print unit 2 perform printing (a printing function). The communication unit 6 can transmit the image data to the computer 200 or the facsimile machine 300 (a transmission function).

During a print job of copying, the control unit 1 uses as print data image data read by the reading unit 3*b*. During a print job of printing, the control unit 1 uses print data received by the communication unit 6. The reading unit 3*b* and the communication unit 6 are data input portions for receiving print data used for printing.

The staple unit 5 is a unit that drives a staple through a bundle of sheets. This permits a bundle of sheets to be bound together with a staple. As shown in FIG. 2, the control unit 1 and the staple unit 5 are not communicably connected together. In other words, the control unit 1 and the staple unit 5 are not connected together via a communication signal line (control signal line). Thus, the control unit 1 does not (cannot) recognize whether or not the staple unit 5 is connected.

Figure 3:
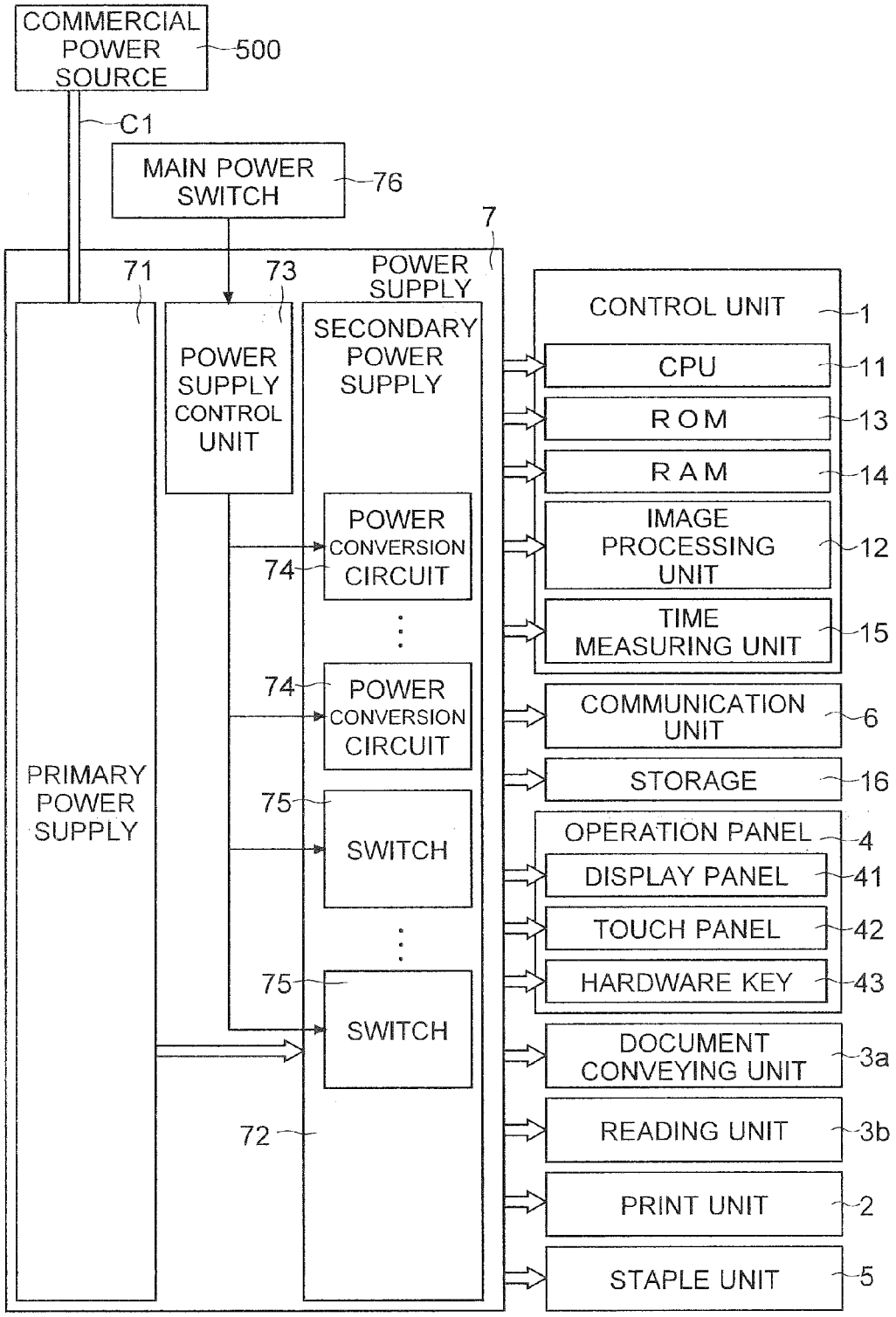
FIG. 3 is a diagram showing an example of an electric power supply system in the multifunction peripheral according to the embodiment.

Active State and Power Saving State:

Next, with reference to FIG. 3, an example of supply of electric power to different blocks in the multifunction peripheral 100 according to the embodiment will be described. The multifunction peripheral 100 includes a power supply 7. The power supply 7 includes a primary power supply 71, a secondary power supply 72, and a power supply control unit 73. A power cord C1 connects between a commercial power source 500 and the multifunction peripheral 100 (primary power supply 71). The primary power supply 71 generates a direct-current voltage from the commercial power source 500 (an alternating-current voltage). The primary power supply 71 generates and outputs a previously set voltage. For example, the primary power supply 71 generates DC 24 V for driving motors.

There are provided various circuits and devices in the multifunction peripheral 100. These circuits and devices require a plurality of different voltages to operate. A plurality of different voltages are required for the operation of the control unit 1, the storage 16, the document conveying unit 3*a*, the reading unit 3*b*, the operation panel 4, the print unit 2, the communication unit 6, and the staple unit 5. Accordingly, the secondary power supply 72 generates a plurality of different direct-current voltages based on the voltage generated by the primary power supply 71.

For the generation of a plurality of different voltages, the secondary power supply 72 includes a plurality of power conversion circuits 74. The power supply control unit 73 turns the power conversion circuits 74 on and off. The power conversion circuits 74 are each a DC converter or a regulator. The output voltages of the power conversion circuits 74 are previously set. The secondary power supply 72 generates and supplies voltages of such levels as are required for the operation of different components. For example, the secondary power supply 72 generates and supplies voltages of such levels as are required for the operation of the control unit 1 (the CPU 11, the image processing unit 12, the ROM 13, the RAM 14, and the time measuring unit 15), the storage 16, the print unit 2, the document conveying unit 3*a* (a control device and a memory), the reading unit 3*b* (an image sensor, a light source, a control device, and a memory), the operation panel 4 (the display panel 41, the touch panel 42, and the hardware keys 43), the staple unit 5, and the communication unit 6.

The multifunction peripheral 100 can be in an active state or in a power saving state. In the active state, the power supply control unit 73 supplies electric power to all the components of the multifunction peripheral 100. In the active state, the multifunction peripheral 100 is kept in a state ready to execute a job immediately. For example, the control unit 1 turns on and off the heater in the fixing unit 2*d*. Thus, the fixing unit 2*d* is kept at a temperature at which fixing is possible. However, in the active state, even when no job is being executed (even on standby), a given amount of electric power is consumed by the components.

The power saving state is a state for reducing power consumption by the multifunction peripheral 100. The power saving state is also called energy-saving mode, power-saving mode, or sleep mode. In the power saving state, the power supply control unit 73 stops supplying electric power to previously defined supply-stop parts. The power supply control unit 73 supplies electric power to the supply-stop parts in the active state. Which parts of the multifunction peripheral 100 to take as supply-stop parts can be determined as desired.

Some of the power conversion circuits 74 supply electric power to both those parts that are supplied with electric power even in the power saving state and the supply-stop parts. To enable them to only stop supplying electric power to the supply-stop parts, a switch 75 is provided. The switch 75 is a switching device such as a transistor. The switch 75 comprises a plurality of switches 75. The switches 75 are provided between the supply-stop parts and the power conversion circuits 74. The power supply control unit 73 turns each switch 75 on and off.

In the multifunction peripheral 100, part or all of the control unit 1, the print unit 2, the storage 16, the document conveying unit 3*a*, the reading unit 3*b*, the display panel 41, and the staple unit 5 are taken as the supply-stop parts. The timing with which supply of electric power to the staple unit 5 is stopped will be described later. Even in the power saving state, electric power is supplied to the power supply control unit 73 and the communication unit 6.

The main power to the multifunction peripheral 100 can be turned on by operating a main power switch 76. For example, the main power switch 76 is provided on a side face of the multifunction peripheral 100. When the main power is turned on, the power supply control unit 73 makes the power conversion circuits 74 start to operate in the previously defined order, at previously defined time points respectively to prevent malfunction. The power supply control unit 73 also turns the switches 75 on at previously defined time points respectively. When the main power is turned on, those parts to which electric power should be supplied in an active state starts to be supplied with electric power in due order. Whichever part has started to be supplied with electric power starts start-up processing. When all the parts have completely started up, starting of the active state is complete.

When a previously defined condition for transition to the power saving state is fulfilled in the active state, the multifunction peripheral 100 makes a transition to a power saving state. The transition condition can be set as desired. Operation on a particular hardware key 43 (Power Saving key, unillustrated) provided on the operation panel 4 is taken as a transition condition.

The control unit 1 recognizes that a transition condition is fulfilled at the lapse of a predetermined time with no subsequent job executed after completion of starting of the active state. When jobs are executed in the active state, the control unit 1 recognizes that a transition condition is fulfilled at the lapse of a predetermined time after completion of the last job. When the operation panel 4 is operated after completion of starting of the active state or after completion of the last job, the control unit 1 recognizes that a transition condition is fulfilled at the lapse of a predetermined time after the last operation on the operation panel 4. When a transition condition is fulfilled, the control unit 1 gives the power supply control unit 73 an instruction. Based on the instruction, the power supply control unit 73 stops supplying electric power to the supply-stop parts.

For transition from the active state to the power saving state, the power supply control unit 73 turns off those power conversion circuits 74 and the switches 75 which supply electric power to the supply-stop parts, in the previously defined order, at previously defined time points respectively. When supply of electric power to all the supply-stop parts has been stopped, transition to the power saving state is complete.

On the other hand, when a previously defined recovery condition is fulfilled in the power saving state, the power supply control unit 73 brings the multifunction peripheral 100 back into the active state. Operation on a particular hardware key 43 (Power key, unillustrated) in the power saving state is taken as a recovery condition. Receiving print data from the computer 200 or the facsimile machine 300 is also taken as a recovery condition. In the power saving state, the power supply control unit 73 supplies electric power to those parts (the hardware keys 43 of the operation panel 4 and the communication unit 6) that detect whether or not a recovery condition is fulfilled.

For return from the power saving state to the active state, the power supply control unit 73 turns on the power conversion circuits 74 and the switches 75 at previously defined time points respectively to supply electric power to the supply-stop parts. The order is previously defined. Thus, the supply of electric power to the supply-stop parts is restarted sequentially. Whichever part has started to be supplied with electric power again starts start-up processing. When all the supply-stop parts have completely restarted, return to the active state is complete.

When the main power of the multifunction peripheral 100 is turned off by operating the main power switch 76, the power supply control unit 73 makes the power conversion circuits 74 stop operating in the previously defined order, at previously defined time points respectively. The supply power control unit 73 also turns off the switches 75 at previously defined time points respectively.

Figure 4:
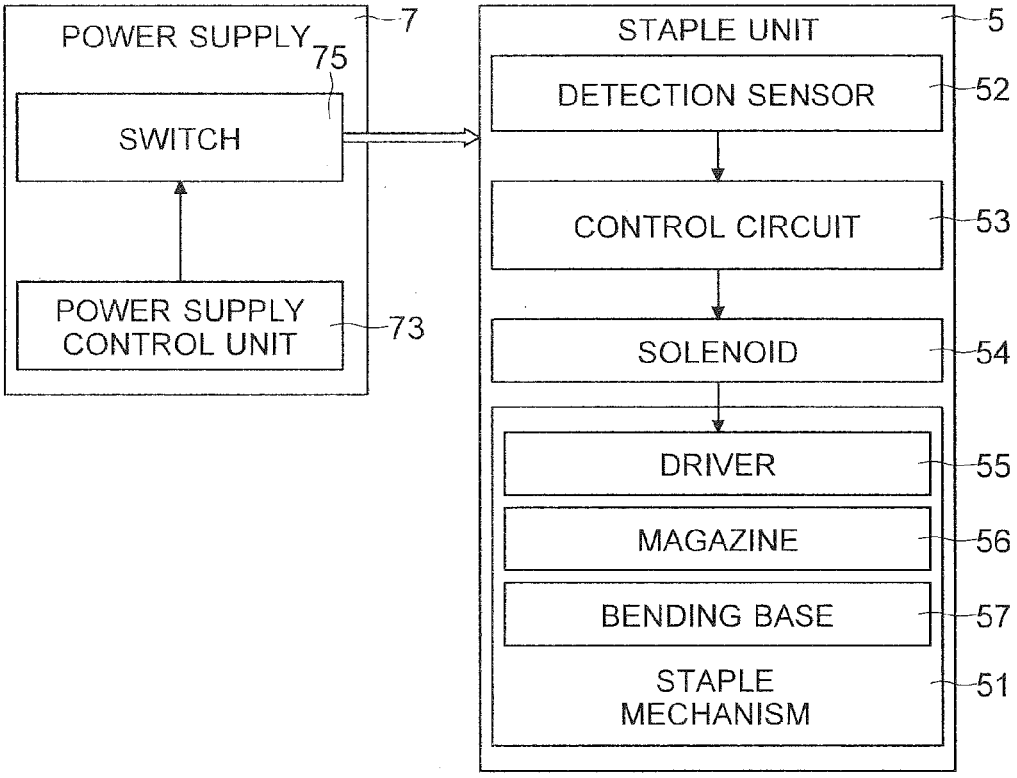
FIG. 4 is a diagram showing an example of a staple unit according to the embodiment.

Staple Unit 5:

Next, with reference to FIGS. 1 and 4, the staple unit 5 according to the embodiment will be described. The staple unit 5 includes a staple mechanism 51, and a detection sensor 52, a control circuit 53, and a solenoid 54 (corresponding to a driving source). The staple mechanism 51 includes a driver 55, a magazine 56, and a bending base 57. These members are housed in a housing of the staple unit 5.

The magazine 56 is loaded with staples. When refilling it with staples, a user opens part of the housing. The driver 55 is a metal plate that pushes down a staple. The bending base 57 is a base on which tip ends of the staple having been driven through sheets are bent inward. Over the bending base 57, the magazine 56 is arranged. Over the magazine 56, the driver 55 is arranged. A gap is formed between the bending base 57 and the magazine 56. Sheets are inserted into this gap.

The detection sensor 52 is a sensor that detects that sheets (a bundle of sheets) are inserted into the gap up to a sufficient depth. The detection sensor 52 may include an actuator (unillustrated) that makes contact with the inserted sheets. The actuator is moved by the inserted sheets. When the actuator is located at a predetermined position, the output of the detection sensor 52 changes. When sheets are inserted deep enough to be penetrated by a staple, the actuator is located at the predetermined position. Here, the output level of the detection sensor 52 changes from a first level to a second level. When the first level is High level, the second level is Low level. When the first level is Low level, the second level is High level. The detection sensor 52 may be an optical sensor.

The output of the detection sensor 52 is fed to the control circuit 53. The control circuit 53 controls the operation of the solenoid 54. When the output of the detection sensor 52 changes from the first level to the second level, the control circuit 53 makes the solenoid 54 operate. For example, the control circuit 53 makes the solenoid 54 protrude its core (magnetic member). By the operation of the solenoid 54, the driver 55 moves downward. The driver 55 pushes down the foremost (forefront) staple in the magazine 56. Thereby, the staple drives through sheets. The driver 55 pushes the staple further down. The staple having driven through the sheets is bent on the bending base 57. Thereby, the sheets are bound together. After being fully protruded, the core is retracted. Thereby, the driver 55 returns to the original position.

The staple unit 5 operates based on electric power supplied from the power supply 7. The power supply control unit 73 controls the switches 75. In the power saving state, the power supply control unit 73 stops supplying electric power to the staple unit 5. In the active state, the power supply control unit 73 supplies electric power to the staple unit 5. Supply of electric power to the staple unit 5 will be described in detail later.

Flow of Transition to Power Saving State:

Next, with reference to FIGS. 5 to 7, a description will be given of an example of the flow of transition to the power saving state in the multifunction peripheral 100 according to the embodiment.

Figure 5:
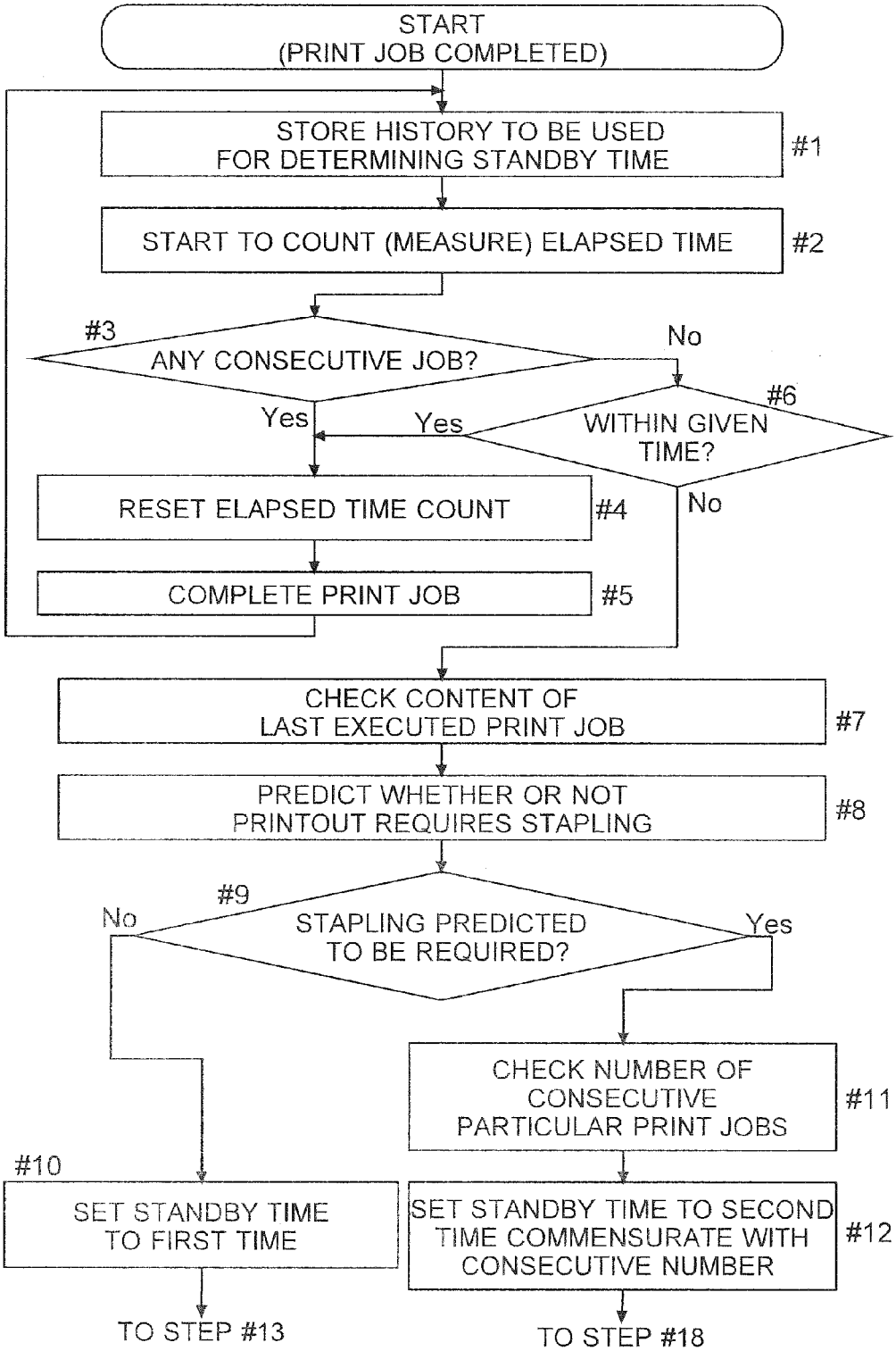
FIG. 5 is a diagram showing an example of a flow of transition to a power saving state in the multifunction peripheral according to the embodiment.
Figure 6:
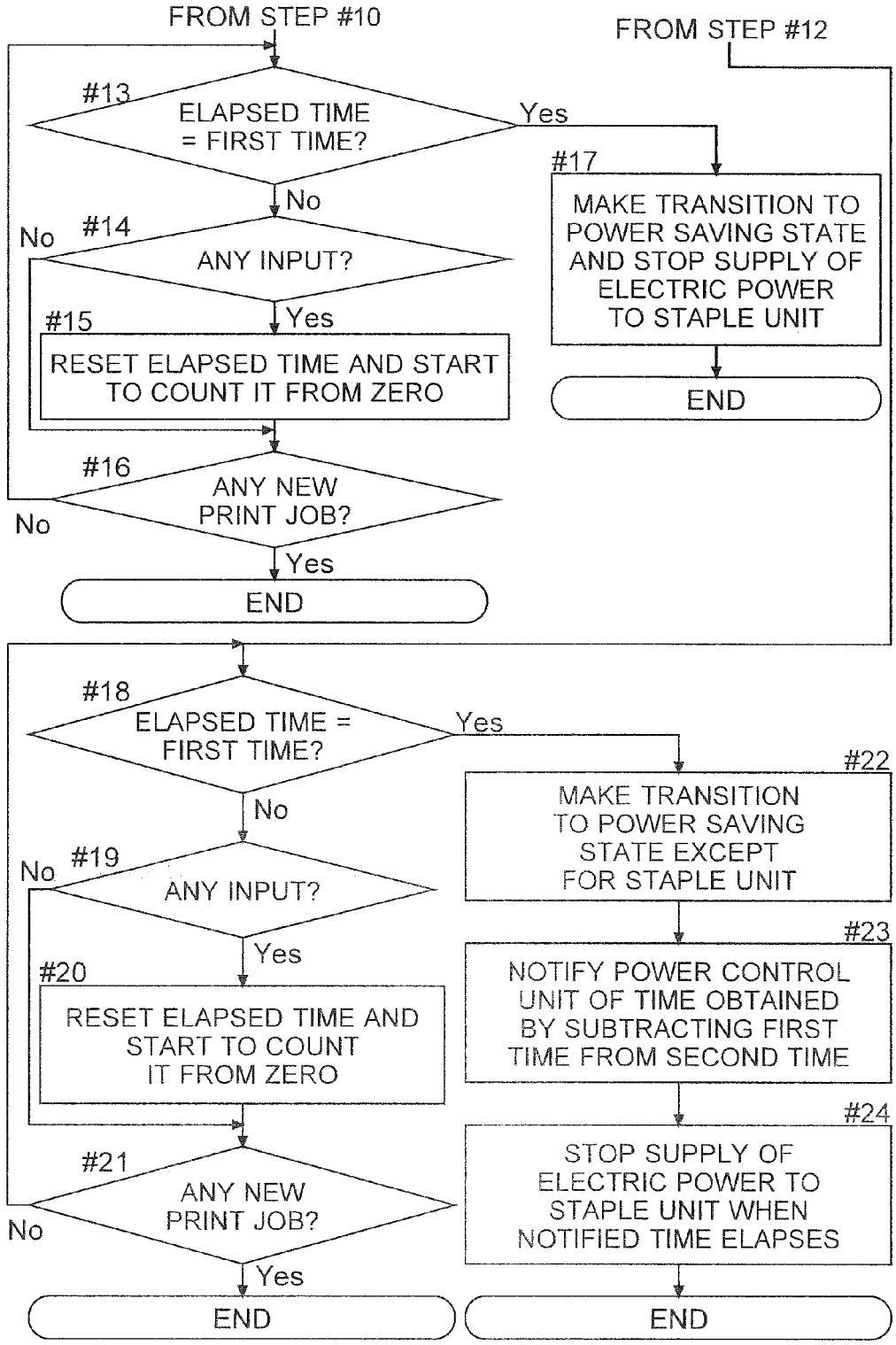
FIG. 6 is a diagram showing an example of the flow of transition to the power saving state in the multifunction peripheral according to the embodiment.

The flow in FIG. 5 starts when a print job is completed in the active state. Here, the print unit 2 is provided with a discharge sensor 22 (see FIG. 2). The discharge sensor 22 is a sensor for detecting discharge of a sheet having undergone printing onto the discharge tray 21. The discharge sensor 22 is, for example, an optical sensor. The discharge tray 21 is provided between the reading unit 3*b* (operation panel 4) and the main body 101 (see FIG. 1). The print unit 2 discharges a sheet having undergone printing onto the discharge tray 21.

The discharge sensor 22 is provided near a sheet discharge opening leading to the discharge tray 21. The discharge sensor 22 changes its output level (between High level and Low level) according to whether or not there is a sheet in a detection region. The output of the discharge sensor 22 is fed to the control unit 1. When the output of the discharge sensor 22 changes from a sheet-absent level to a sheet-present level, the control unit 1 recognizes that the leading end of a sheet has reached the installation position of the discharge sensor 22.

On the other hand, when the output changes from the sheet-present level to the sheet-absent level, the control unit 1 recognizes that the trailing end of the sheet have passed by the installation position of the discharge sensor 22. On recognizing the passage of the trailing end, the control unit 1 recognizes that the sheet has been discharged. On recognizing discharge of the last sheet of a print job, the control unit 1 recognizes that the print job is complete (Start).

The control unit 1 stores a history to be used for determining a standby time (Step #1). The history can be stored in the RAM 14 or the storage 16. The control unit 1 stores the content of a completed print job as the history. The control unit 1 stores, as the history, data based on which to discriminate whether the completed print job is a print job of only one page, a print job of a plurality of sheets of the same page, or a particular print job.

Figure 7:
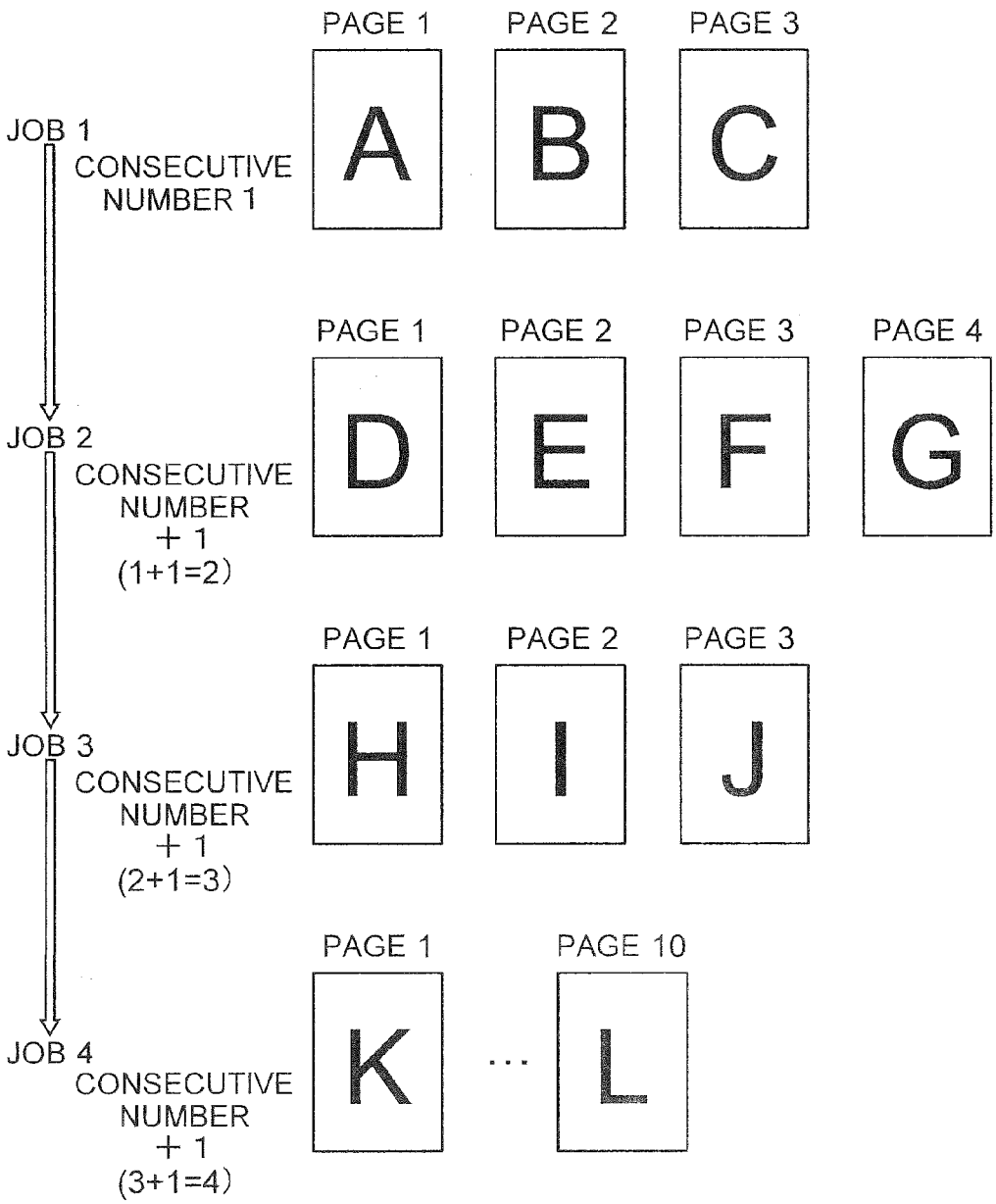
FIG. 7 is a diagram showing an example of a particular print job according to the embodiment.

The print jobs shown in FIG. 7 are each a particular print job. As shown in FIG. 7, a particular job is a print job to print a plurality of pages having different content. A job to print a document comprising a plurality of pages in order of pages is a particular print job. FIG. 7 shows an example in which four particular jobs are executed successively.

The control unit 1 checks the data of the pages included in a print job. In other words, the control unit 1 checks the content of the image data of a document read for copying or of print data. The control unit 1 determines, based on the check result, whether the print job is to print only one page, to print a plurality of sheets of the same page or to the particular print job.

Then, the control unit 1 (time measuring unit 15) starts to count (measure) time (Step #2). That is, the control unit 1 measures the time that elapses after completion of the print job. Then, the control unit 1 checks whether or not there is a subsequent print job to be executed (Step #3). In other words, the control unit 1 checks whether or not there is a subsequent print job to be executed immediately after the last completed print job.

The control unit 1 determines that there is a subsequent print job to be executed in either of the following cases. (1) When a print job of copying remains unexecuted. This results, for example, when an instruction is given to execute a new print job of copying while another print job is being executed. (2) When a print job of printing remains unexecuted. This results, for example, when the communication unit 6 receives print data while a print job is being executed.

When there is a subsequent print job to be executed (Step #3, Yes), the control unit 1 resets the time count (Step #4). Then, the control unit 1 makes the print unit 2 operate. Eventually, the subsequent print job thus executed is complete (Step #5). The flow then returns to Step #1.

When there is no subsequent print job to be executed (Step #3, No), the control unit 1 checks whether or not another print job has been started within a given time after completion of the previous print job (Step #6). The given time is shorter than a standby time (a first time and a second time, which will be described later). For example, the given time can be longer than zero seconds but equal to or shorter than ten and several seconds. In Step #6, it is checked whether or not there is a print job that can be considered a subsequent print job. When another print job is started within the given time (Step #6, Yes), the flow proceeds to Step #4. As a result, when the time after completion of a particular print job until the start of a subsequent particular print job falls within the given time, the control unit 1 recognizes that particular print jobs are executed successively.

When no job is started within the given time (Step #6, No), the control unit 1 checks the content of the last completed job (Step #7). The control unit 1 checks the latest history of Step #1. Based on the content (history) of the last completed print job, the control unit 1 predicts whether or not the printout requires stapling (Step #8).

When the last completed print job is a particular print job, the control unit 1 predicts that stapling is required (Step #9). When the last completed print job is a print job to print only one page, the control unit 1 predicts that no stapling is required (Step #9). When the last completed print job is a print job to print a plurality of pages having the same content, the control unit 1 predicts that no stapling is required (Step #9).

When it is predicted that no stapling is required (Step #9, No), the control unit 1 sets the standby time to a first time (Step #10). The first time can be set as desired. In the multifunction peripheral 100, the first time is given a default value of one minute. The first time can be adjusted through input made on the operation panel 4. On the other hand, when it is predicted that stapling is required (Step #9, Yes), the control unit 1 checks the number of consecutive particular print jobs (Step #11). The control unit 1 sets a second time commensurate with the consecutive number as the standby time (Step #12). Step #11 and Step #12 will be described in detail later.

When it is predicted that no stapling is required (Step #9, No), the control unit 1 checks whether or not the elapsed time equals the first time (Step #13). When the time elapsed does not equal the first time (Step #13, No), the control unit 1 checks whether or not an operation is performed on the multifunction peripheral 100 (Step #14). In Step #14, it is checked whether or not a transition can be made to the power saving state. More specifically, the control unit 1 checks whether or not an operation is performed on the operation panel 4. The control unit 1 checks whether or not an operation is performed on the hardware keys 43. The control unit 1 checks whether or not a touch is made on the touch panel 42. When an operation is performed on the multifunction peripheral 100 (operation panel 4) (Step #14, Yes), the control unit 1 resets the elapsed time up to then and starts to count the elapsed time from zero (Step #15). That is, a user may be operating, and thus the start point of the elapsed time is shifted to a time point of operation.

After Step #15, and also when no operation is performed on the multifunction peripheral 100 (Step #14, No), the control unit 1 checks whether or not a new print job is started before the elapsed time equals the first time (Step #16). When a new print job is started (Step #16, Yes), the flow ends (End). Then, when the new print job is complete, the flow starts from Step #1. When no new print job is started (Step #16, No), the flow returns to Step #13.

When the elapsed time equals the first time (Step #13, Yes), the control unit 1 brings the multifunction peripheral 100 into the power saving state (Step #17). More specifically, the control unit 1 instructs the power supply control unit 73 to make a transition to the power saving state. The power supply control unit 73 stops supply of electric power to the supply-stop parts including the print unit 2. Thus, at Step #17, supply of electric power to the staple unit 5 is stopped. Then, the flow ends (End).

When it is predicted at Step #9 that stapling is required (Step #9, Yes), the control unit 1 checks the number of consecutive particular print jobs (Step #11). The consecutive number is a value counted by the control unit 1. The consecutive number indicates how many particular print jobs are executed successively. The last completed print job is also included. The control unit 1 checks the consecutive number based on the stored history. When, as shown in FIG. 7, four particular print jobs including the last completed print job are executed, it means that four particular print jobs follow one after the next. Accordingly, in this case, the control unit 1 recognizes that the consecutive number is four. When only one particular print job is executed, the consecutive number is one. That is, the consecutive number is counted from one.

The control unit 1 sets a second time commensurate with the consecutive number as the standby time (Step #12). The second time is longer than the first time. The larger the consecutive number is, the longer the second time is. When only one particular print job is executed (when the consecutive number is one), the second time is given a default value of two minutes. The second time is equal to or longer than two minutes.

Every time the consecutive number increases by one, a predetermined additional time is added to the second time (standby time). Let the first time be A, let the consecutive number be B, let the additional time be C, then the second time is defined as follows.

$$\text{the second time} = A + (B \times C) \qquad \text{(formula)}$$

By default, A=one minute, and C=one minute. Through input on the operation panel 4, A and C can be adjusted.

When the last completed print job is a particular print job and when two particular print jobs were executed before the last completed print job, the consecutive number is three. In this case, three documents may be stapled. When stapling may be required a plurality of times, the control unit 1 lengthens the second time. By default, the second time is calculated, based on formula above, as 1+(3×1 minute)=4 minutes. Unlike with the first time, one minute per document is added to the standby time. In preparation for stapling, a user sorts out printouts. The user puts pages of each document together to align at the top and bottom. The user inserts a bundle of sheets into a gap so as not to break them up. Preparing for stapling can be troublesome. The lengthened standby time permits the user to take his or her time to prepare for stapling.

Then, the control unit 1 checks whether or not the elapsed time equals the first time (Step #18). When the elapsed time does not equal the first time (Step #18, No), the control unit 1 checks whether or not an operation is performed on the multifunction peripheral 100 (Step #19). More specifically, the control unit 1 checks whether or not an operation is performed on the operation panel 4. The control unit 1 checks whether or not an operation is performed on the hardware keys 43. The control unit 1 checks whether or not a touch is made on the touch panel 42. When an operation is performed on the multifunction peripheral 100 (operation panel 4) (Step #19, Yes), the control unit 1 resets the elapsed time up to then and starts to count the elapsed time from zero (Step #20). That is, a user may be operating, and thus the start point of the elapsed time is shifted to a time point of operation.

After Step #20, and also when no operation is performed on the multifunction peripheral 100 (Step #19, No), the control unit 1 checks whether or not a new print job is started before the elapsed time equals the second time (Step #21). When a new print job is started (Step #21, Yes), the flow ends. Then, when the new print job is complete, the flow starts from Step #1. When no new print job is started (Step #21, No), the flow returns to Step #18.

When the elapsed time equals the first time (when the first time has elapsed after completion of a print job or after an operation on the operation panel 4, Step #18, Yes), the control unit 1 brings the multifunction peripheral 100 into the power saving state (Step #22). The control unit 1 instructs the power supply control unit 73 to stop supply of electric power to the supply-stop parts (including the print unit 2) except for the staple unit 5. The power supply control unit 73 does not stop supply of electric power to the staple unit 5. The power supply control unit 73 stops supply of electric power to the rest of the supply-stop parts. The control unit 1 simultaneously notifies the power supply control unit 73 of the time obtained by subtracting the first time from the second time (Step #23).

When the notified time (the time difference between the second time and the first time) has elapsed after the start of a transition to the power saving state (after Step #22), the power supply control unit 73 stops supply of electric power to the staple unit 5 (Step #24). As a result, when the second time has elapsed after completion of a job, supply of electric power to the staple unit 5 is stopped. This permits printouts to be bound together even when the multifunction peripheral 100 is in the power saving state. Then, the transition to the power saving state is complete (End). At Step #18, the control unit 1 may check whether or not the elapsed time equals the second time. When the elapsed time equals the second time, the control unit 1 may stop supply of electric power to all the supply-stop parts including the staple unit 5. In this case, Step #23 and Step #24 are unnecessary.

As described above, the image forming apparatus according to the embodiment includes a staple unit 5, a data input portion (a reading unit 3*b* and a communication unit 6), a print unit 2, a power supply 7, and a control unit 1. The staple unit 5 includes a staple mechanism 51 by which a staple is driven through a bundle of sheets and a driving source (solenoid 54) which makes the staple mechanism 51 operate. The data input portion receives print data used for printing. The print unit 2 executes a print job based on print data. The power supply 7 supplies electric power to the staple unit 5. The control unit 1 makes the power supply 7 supply electric power to the staple unit 5 at least until a standby time elapses after completion of a print job. The control unit 1 starts to count the time that elapses after completion of a print job. The control unit 1 makes the power supply 7 stop supply of electric power to the staple unit 5 when the elapsed time equals the standby time. The control unit 1 is not connected to the staple unit 5 via a communication signal line. The control unit 1 does not recognize whether or not the staple unit 5 is present. The control unit 1 predicts whether or not the printout of an executed print job requires stapling. When it is predicted that no stapling is required, the control unit 1 sets the standby time to a first time. When it is predicted that stapling is required, the control unit 1 sets the standby time to a second time that is longer than the first time.

With this configuration, the standby time can be adjusted according to the content of a print job. The standby time is the time after completion of a print job until supply of electric power to the staple unit 5 stops. The standby time can be lengthened only when the staple unit 5 is used. Thus, even in an image forming apparatus in which no communication is performed between a control circuit in its main body and a staple unit 5, supply of electric power to the staple unit 5 does not stop before stapling. Supply of electric power to the staple unit 5 does not stop while a user is aligning a bundle of sheets. Until the user finishes stapling, the staple unit 5 is kept in a usable state.

After use of the staple unit 5, a transition is made automatically to a power saving state. There is no need to change the configuration of the hardware of the image forming apparatus, such as by establishing additional communication signal lines. When the staple unit 5 is not used, the standby time is shortened. Thus, it is possible to speedily bring the staple unit 5 into a power saving state.

When a document is printed page by page, a plurality of pages having different content are printed. This kind of printout (document) is often bound together with a staple. Accordingly, when a particular print job which is a print job to print a plurality of pages having different content is executed, the control unit 1 predicts that stapling is required. This makes it possible to lengthen the standby time when a document that is more likely to be bound together with a staple is printed. Thus, it is possible to prevent supply of electric power to the staple unit 5 from stopping before stapling (during preparation operation).

The control unit 1 counts the number of consecutive particular print jobs, starts to count time after completion of the last particular print job, and makes the second time longer as the consecutive number increases. This makes it possible to make the standby time longer as the number of documents that need to be stapled increases. It is thus possible to stop supply of electric power to the staple unit 5 after all the documents have been stapled. Thus, it is possible to prevent supply of electric power to the staple unit 5 from stopping before stapling of a plurality of documents is complete.

When the time after completion of a particular print job until the start of a subsequent particular print job falls within a given time which is previously defined, the control unit 1 recognizes that particular print jobs are executed successively. Thus, when the interval between print jobs falls within the given time, it can be considered that jobs follow one after the next. When the printouts of print jobs are stapled, it is possible to prevent supply of electric power to the staple unit 5 from stopping during the operation.

Usually, no stapling is required for a printout comprising a single sheet. Accordingly, when a print job to print only one page is executed, the control unit 1 predicts that no stapling is required. This makes it possible to correctly predict whether or not the printout requires stapling. When no stapling is required, it is possible to speedily bring the staple unit 5 into a power saving state.

For example, when printouts each comprising a single sheet are distributed to a plurality of people respectively, a plurality of sheets of the same page are printed. When a plurality of pages having the same content are printed, they are less likely to be stapled. Accordingly, when a print job to print a plurality of pages having the same content is executed, the control unit 1 predicts that no stapling is required. This makes it possible to correctly predict whether or not the printout requires stapling. When no stapling is required, it is possible to speedily bring the staple unit 5 into a power saving state.

When the elapsed time equals the first time, the control unit 1 makes the power supply 7 stop supply of electric power to the print unit 2. Thus, when the standby time is set to the second time, it is possible to first bring all other parts except for the staple unit 5 into a power saving state. It is not necessary for the entire image forming apparatus to wait to make a transition to a power saving state until the second time elapses. Thus, it is possible to provide an image forming apparatus that achieves high power-saving performance.

In a case where it is predicted that stapling is required, when the elapsed time equals the first time, the control unit 1 notifies the power supply 7 (power supply control unit 73) of the time obtained by subtracting the first time from the second time. When the notified time elapses, the power supply 7 stops supply of electric power to the staple unit 5. It is possible to stop supply of electric power to the staple unit 5 after stapling is complete.

The image forming apparatus further includes an operation panel 4 on which operations are received. When an operation is performed on the operation panel 4, the control unit 1 resets the elapsed time and starts to count the elapsed time from zero. When a user may be operating, the start point of the elapsed time can be shifted to a time point of operation.

While some embodiments of the present disclosure have been described above, they are in no way meant to limit the scope of the present disclosure, which thus allows for many modifications and variations within the spirit of the present disclosure.

What is claimed is:

1. An image forming apparatus comprising:

a staple unit including a staple mechanism by which a staple is driven through a bundle of sheets and a driving source which makes the staple mechanism operate;

a data input portion for receiving print data used for printing;

a print unit which executes a print job based on the print data;

a power supply which supplies electric power to the staple unit; and a control unit which makes the power supply electric power to the staple unit at least until a standby time elapses after completion of a print job, starts to count time that elapses after completion of a print job, makes the power supply stop supply of electric power to the staple unit when the elapsed time equals the standby time, is not connected to the staple unit via a communication signal line, does not recognize whether or not the staple unit is present, predicts whether or not a printout of an executed print job requires stapling, sets, when it is predicted that no stapling is required, the standby time to a first time, and sets, when it is predicted that stapling is required, the standby time to a second time that is longer than the first time.

2. The image forming apparatus of claim 1, wherein when a particular print job which is a print job to print a plurality of pages having different content, the control unit predicts that stapling is required.

3. The image forming apparatus of claim 2, wherein the control unit counts a number of consecutive particular print jobs, starts to count time after completion of a last particular print job, and makes the second time longer as the consecutive number increases.

4. The image forming apparatus of claim 3, wherein when a time after completion of a particular print job until a start of a subsequent particular print job falls within a given time which is previously defined, the control unit recognizes that particular print jobs are executed successively.

5. The image forming apparatus of claim 1, wherein when a print job to print only one page is executed, the control unit predicts that no stapling is required.

6. The image forming apparatus of claim 1, wherein when a print job to print a plurality of pages having same content is executed, the control unit predicts that no stapling is required.

7. The image forming apparatus of claim 1, wherein when the elapsed time equals the first time, the control unit makes the power supply stop supply of electric power to the print unit.

8. The image forming apparatus of claim 7, wherein in a case where it is predicted that stapling is required, when the elapsed time equals the first time, the control unit notifies the power supply of a time obtained by subtracting the first time from the second time, and when the notified time elapses, the power supply stops supply of electric power to the staple unit.

9. The image forming apparatus of claim 1, further comprising:

an operation panel on which operations are received, wherein when an operation is performed on the operation panel, the control unit resets the elapsed time and starts to count the elapsed time from zero.

10. A method for controlling an image forming apparatus, comprising:

executing a print job based on print data received by a data input portion;

supplying electric power to a staple unit including a staple mechanism by which a staple is driven through a bundle of sheets and a driving source which makes the staple mechanism operate;

supplying electric power to the staple unit at least until a standby time elapses after completion of a print job;

starting to count time that elapses after completion of a print job;

stopping supply of electric power to the staple unit when the elapsed time equals the standby time;

not connecting to the staple unit via a communication signal line;

not recognizing whether or not the staple unit is present;

predicting whether or not a printout of an executed print job requires stapling;

setting, when it is predicted that no stapling is required, the standby time to a first time; and setting, when it is predicted that stapling is required, the standby time to a second time that is longer than the first time.

* * * * *